US010497492B2

(12) United States Patent
Miyamoto et al.

(10) Patent No.: US 10,497,492 B2
(45) Date of Patent: Dec. 3, 2019

(54) TERMINAL AND CABLE WITH TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kenji Miyamoto, Mie (JP); Kazuaki Hamada, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/312,340

(22) PCT Filed: Jun. 2, 2017

(86) PCT No.: PCT/JP2017/020566
§ 371 (c)(1),
(2) Date: Dec. 21, 2018

(87) PCT Pub. No.: WO2017/221668
PCT Pub. Date: Dec. 28, 2017

(65) Prior Publication Data

US 2019/0221329 A1 Jul. 18, 2019

(30) Foreign Application Priority Data

Jun. 21, 2016 (JP) ..... 2016-122444

(51) Int. Cl.
*H01R 4/18* (2006.01)
*H01B 7/40* (2006.01)
*H01R 4/64* (2006.01)

(52) U.S. Cl.
CPC ..... *H01B 7/40* (2013.01); *H01R 4/18* (2013.01); *H01R 4/64* (2013.01)

(58) Field of Classification Search
CPC ... H01B 7/40; H01R 4/64; H01R 4/18; H01R 9/0518; H01R 4/184
See application file for complete search history.

(56) References Cited

U.S. PATENT DOCUMENTS 4,781,623 A * 11/1988 Philippson ..... H01R 24/62 439/670
5,658,163 A * 8/1997 DeRoss ..... H01R 4/2495 174/84 C (Continued)

FOREIGN PATENT DOCUMENTS

| | | |
|---|---|---|
| JP | 2006-244815 | 9/2006 |
| JP | 2013-062168 | 4/2013 |
| JP | 2013-182727 | 9/2013 |

OTHER PUBLICATIONS

International Search Report dated Aug. 15, 2017.

*Primary Examiner* — Truc T Nguyen
(74) *Attorney, Agent, or Firm* — Gerald E. Hespos; Michael J. Porco; Matthew T. Hespos

(57) ABSTRACT

A cable with terminal includes a coaxial cable in which a core, an inner insulating layer, a shield layer and an outer insulating layer are concentrically arranged from an inner side to an outer side, and a terminal connected to the coaxial cable. The terminal includes a pair of barrel pieces crimped in an overlapping state to an exposed part of the shield layer. An engaging protrusion is provided on the barrel piece on one side out of the pair of barrel pieces and projects toward the barrel piece on the other side. The engaging protrusion is engaged with a hole edge part of an engaging hole provided in the barrel piece on the other side.

8 Claims, 14 Drawing Sheets

(56) References Cited

U.S. PATENT DOCUMENTS

| | | | | |
|---|---|---|---|---|
| 5,725,387 | A * | 3/1998 | O'Sullivan | H01R 4/187 439/98 |
| 6,059,607 | A * | 5/2000 | Wilson | H01R 13/648 439/607.47 |
| 6,206,727 | B1 * | 3/2001 | Aoyama | H01R 9/0518 439/424 |
| 6,350,145 | B1 * | 2/2002 | Chen | H01R 4/182 439/422 |
| 7,896,715 | B2 * | 3/2011 | Kumakura | H01R 4/185 439/442 |
| 2004/0147166 | A1 * | 7/2004 | Lai | H01R 9/032 439/607.51 |
| 2006/0089046 | A1 * | 4/2006 | Annequin | H01R 43/048 439/578 |
| 2009/0035991 | A1 * | 2/2009 | Sakaguchi | H01R 4/184 439/585 |
| 2009/0098769 | A1 * | 4/2009 | Sakamoto | H01R 4/184 439/578 |
| 2012/0202372 | A1 * | 8/2012 | Hardy | H01R 9/0518 439/460 |
| 2013/0126236 | A1 * | 5/2013 | Suzuki | H01R 4/185 174/84 C |
| 2013/0224996 | A1 | 8/2013 | Miyawaki et al. | |
| 2013/0344738 | A1 * | 12/2013 | Kanda | H01R 13/6592 439/607.5 |
| 2014/0182931 | A1 | 7/2014 | Furukawa | |
| 2015/0118917 | A1 * | 4/2015 | Poma | H01R 4/184 439/877 |

* cited by examiner

TERMINAL AND CABLE WITH TERMINAL

BACKGROUND

Field of the Invention

This specification relates to a terminal and a cable with terminal.

Related Art

A known cable connection structure connects a terminal with an inner conductor terminal and an outer conductor terminal to an end of a coaxial cable in which an inner insulating layer, a shield layer and an outer insulating layer are arranged concentrically from an inner side to an outer side on an outer peripheral side of a core.

More particularly, as shown in FIG. 11, an end of a cable 1 is stripped to expose a core 2, an inner insulating layer 3 and a shield layer 4 in a stepwise manner. An inner conductor terminal (not shown) is connected to the core 2, whereas barrel pieces 7 for shield layer provided on an outer conductor terminal 6 and barrel pieces (not shown) for outer insulating layer are respectively crimped to the end of the shield layer 4 and the outer insulating layer 5.

In the cable 1 of this type, a part between the shield layer 4 and the outer insulating layer 5 is relatively slippery. Thus, if a tensile load is applied in an axial direction of the cable 1, the outer insulating layer 5 is shifted relatively easily from the shield layer 4 and only the outer insulating layer 5 may be pulled first. Therefore, the barrel pieces 7 to be crimped to the shield layer 4 need to have a certain fixing force. Further, if the terminal is provided with no barrel piece for outer insulating layer, the fixing force of the barrel pieces 7 to be crimped to the shield layer 4 must be stronger.

On the other hand, considering a transmission characteristic of the cable 1 of this type, a high frequency characteristic is reduced if a separation distance between the core 2 and the shield layer 4 changes. Thus, in crimping the barrel pieces 7 to the shield layer 4, the barrel pieces 7 preferably are crimped with a force uniform in a circumferential direction of the shield layer 4 without deforming the inner insulating layer 3.

However, in the case of crimping the barrel pieces 7 with a force uniform in the circumferential direction, the fixing force for the cable 1 tends to be reduced as compared to the configuration for crimping the barrel pieces 7 while causing tip sides thereof or projections provided thereon to bite into the shield layer 4.

If a tensile load acting in the axial direction of the cable 1 is applied to a crimping portion having a relatively low fixing force, as just described, the tip sides of barrel pieces 7 crimped to the shield layer 4 are pulled relatively easily in a tensile direction and may be shifted from an original crimping position (see FIG. 13). If the tip sides of the barrel pieces 7 are shifted in this way, the fixing force of the barrel pieces 7 for the cable 1 becomes nonuniform in the circumferential direction and the separation distance between the core 2 and the shield layer 4 accordingly changes. Therefore the high frequency characteristic may be reduced (see FIG. 14).

The invention was completed on the basis of the above situation and aims to provide a terminal and a cable with terminal in which tip sides of two barrel pieces crimped to a shield layer are unlikely to be shifted in an axial direction even if a tensile force is applied in the axial direction to a coaxial cable and that are excellent in high frequency characteristic.

SUMMARY

The invention is directed to a terminal to be connected to a coaxial cable in which a core, an inner insulating layer, a shield layer and an outer insulating layer are arranged concentrically from an inner side to an outer side. The terminal includes first and second opposed barrel pieces to be crimped in an overlapping state to an exposed part of the shield layer. An engaging protrusion is provided on the first barrel piece and projects toward the second barrel piece in a crimped state where the barrel pieces are crimped to the shield layer. An engaging hole is provided in the second barrel piece and engages an edge of the engaging hole in the crimped state.

The invention also is directed to a cable with a terminal. The cable is a coaxial cable in which a core, an inner insulating layer, a shield layer and an outer insulating layer are arranged concentrically from an inner side to an outer side. The terminal includes first and second opposed barrel pieces to be crimped in an overlapping state to an exposed part of the shield layer. An engaging protrusion is provided on the first barrel piece and projects toward the second barrel piece. The engaging protrusion is engaged with an edge of an engaging hole provided in the second barrel piece.

According to the above configurations, the engaging protrusion of the first barrel piece is engaged with the edge of the engaging hole of the second barrel piece in the crimped state where the barrel pieces of the terminal are crimped to the shield layer of the coaxial cable. Thus, even if a tensile force is applied to the coaxial cable in an axial direction of the coaxial cable, the tips of the barrel pieces will not shift from an original crimping position. In other words, even if a tensile force is applied to the coaxial cable in the axial direction of the coaxial cable, the barrel pieces remain crimped to the shield layer with a force substantially uniform in a circumferential direction of the coaxial cable.

Thus, a separation distance between the core and the shield layer is kept constant in the circumferential direction. Therefore the cable with terminal is excellent in high frequency characteristic.

The engaging protrusion and the edge of the engaging hole may be long and narrow in a direction intersecting an extending direction of the coaxial cable. According to this configuration, when a tensile force is applied to the coaxial cable in the axial direction of the coaxial cable, the engaging protrusion and the hole edge part of the engaging hole can be held in a locked state in a wide area extending in the direction intersecting the extending direction of the coaxial cable. Thus, the state crimped to the shield layer can be maintained more stably.

A projecting dimension of the engaging protrusion from a surface of the first barrel piece may be set such that the engaging protrusion does not project from a surface of the second barrel piece with the engaging protrusion engaged with the edge of the engaging hole. According to this configuration, the engaging protrusion does not project from the surface of the second barrel piece. Therefore the engaging protrusion will not be caught by other components and will not bite into the shield layer.

The engaging protrusion may project radially outward of the coaxial cable in the crimped state. Specifically, the second barrel piece may be crimped while being overlapped on an outer side of the first barrel piece. According to this configuration, positioning at the time of a crimping operation can be performed more easily.

According to the invention, a terminal and a cable with terminal are obtained in which tips of first and second barrel pieces crimped to a shield layer are unlikely to be shifted in an axial direction even if a tensile force is applied to a coaxial cable in the axial direction of the coaxial cable while being excellent in high frequency characteristic.

DETAILED DESCRIPTION

Figure 1:
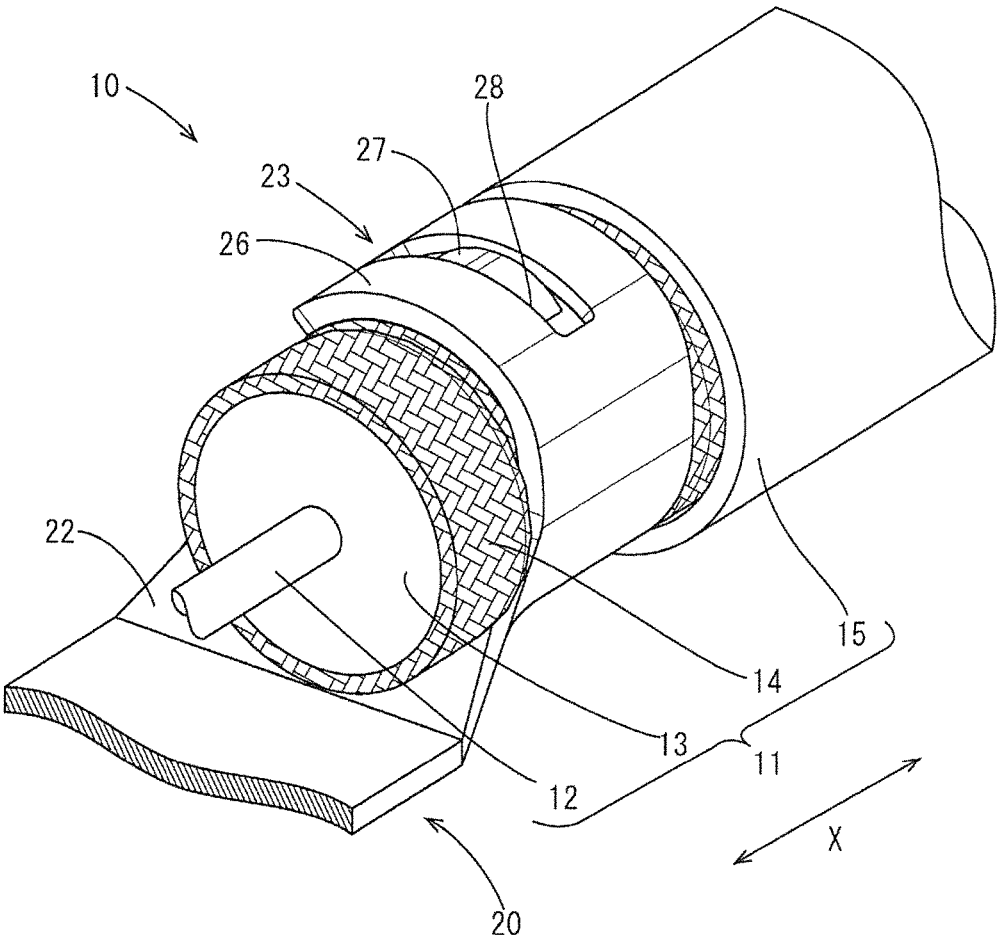
FIG. 1 is a partial enlarged perspective view of a cable with terminal of one embodiment.
Figure 2:
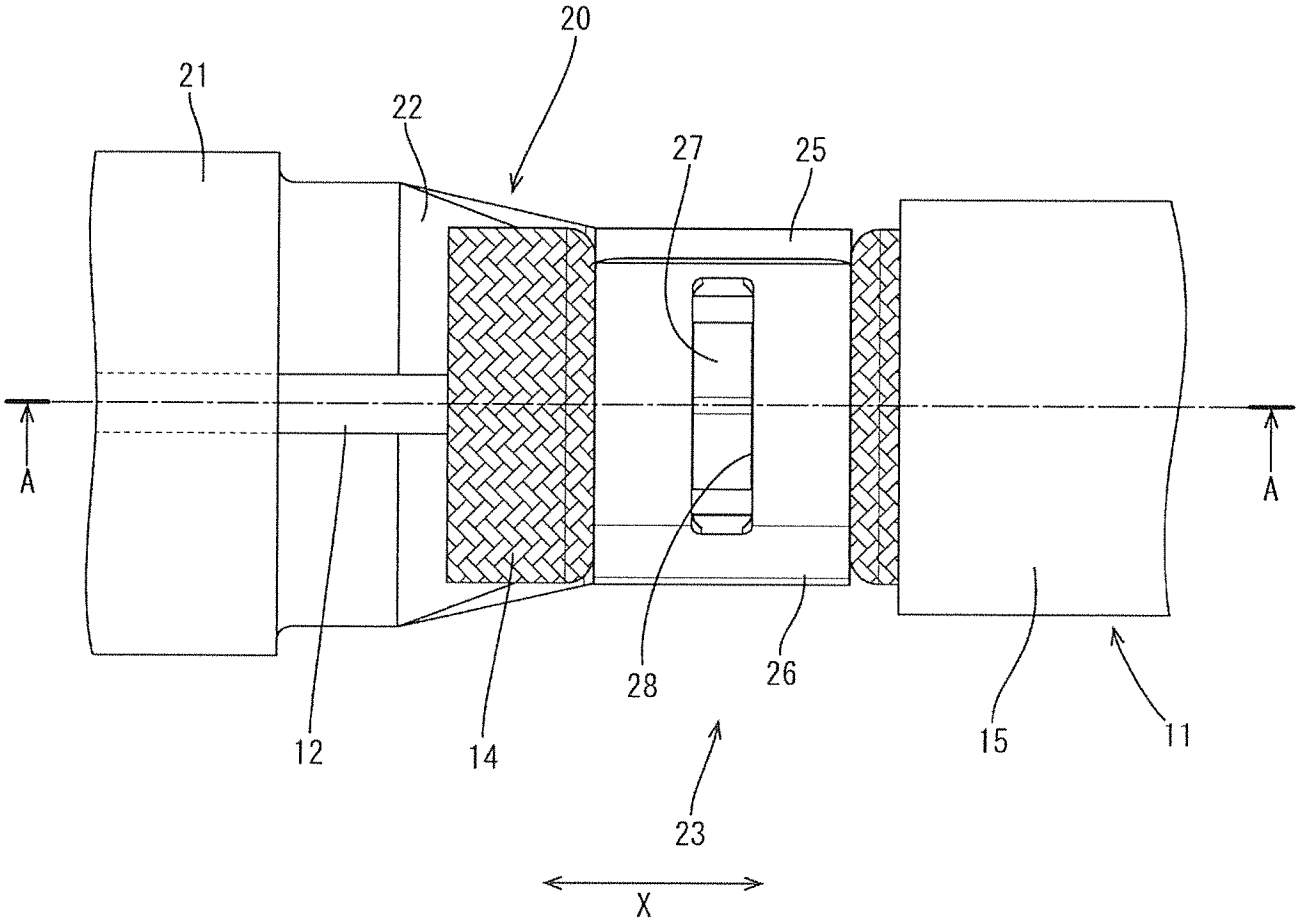
FIG. 2 is a partial enlarged plan view of the cable with terminal.
Figure 3:
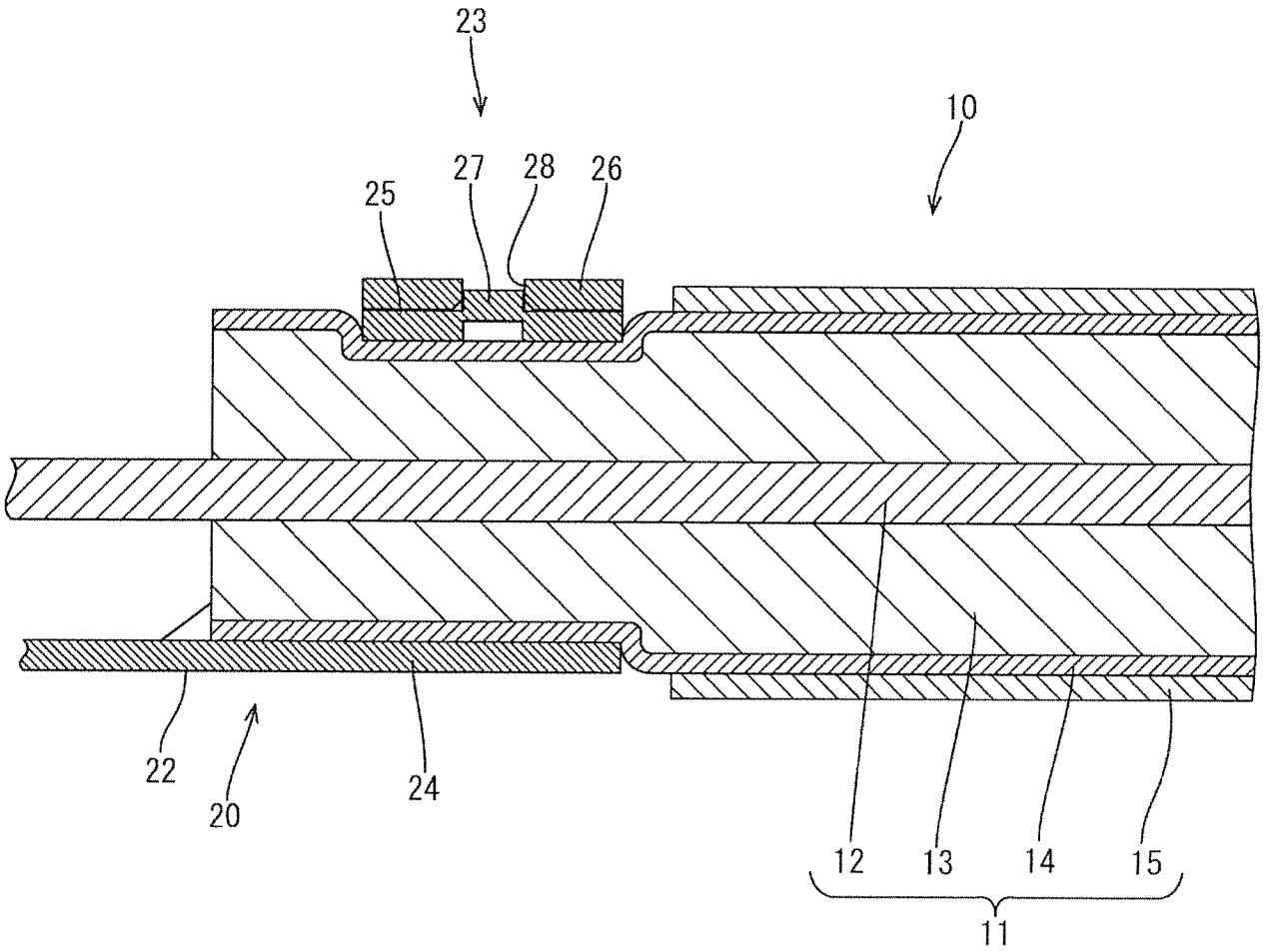
FIG. 3 is a section along A-A of FIG. 2.

A terminal 20 and a cable with terminal 10 of one embodiment are described on the basis of FIGS. 1 to 9. In this embodiment, as shown in FIG. 1, the terminal 20 is connected to an end of a cable 11. Note that, in the following description, left and right sides of FIG. 2 are referred to respectively as front and rear ends.

(Cable 11)

The cable 11 of this embodiment is a so-called coaxial cable in which a core 12 formed of a twisted wire composed of one metal strand or plural metal strands, a relatively thick inner insulating layer 13, a shield layer 14 formed of a braided wire and an outer insulating layer 15 made of an insulating material such as synthetic resin are arranged concentrically from an inner side to an outer side (see FIG. 1).

On an end of this cable 11, an end processing such as stripping is applied to expose an end of each of the core 12, the inner insulating layer 13 and the shield layer 14.

(Terminal 20)

The terminal 20 includes an unillustrated inner terminal to be connected to the core 12 and connectable to an unillustrated mating terminal, an outer terminal to be connected to the shield layer 14 and an unillustrated dielectric (insulator) interposed between these inner and outer terminals to insulate both from each other. This embodiment relates to a crimping structure of the outer terminal of the terminal 20 to the shield layer 14.

The outer terminal 20 is formed by press-working a metal plate excellent in conductivity. A front side of the outer terminal 20 is formed into a rectangular fitting tube 21 (see FIG. 2) into which the dielectric is to be fit. A crimping portion 23 is provided integrally on the rear end and is to be crimped to the end of the shield layer 14 (see FIGS. 7 to 9).

The crimping portion 23 includes a placing portion 24 extending rearward via a coupling 22 extending from a bottom wall of the fitting tube 21, and first and second barrel pieces 25, 26 extend sideways from first and second sides of the placing portion 24.

Figure 6:
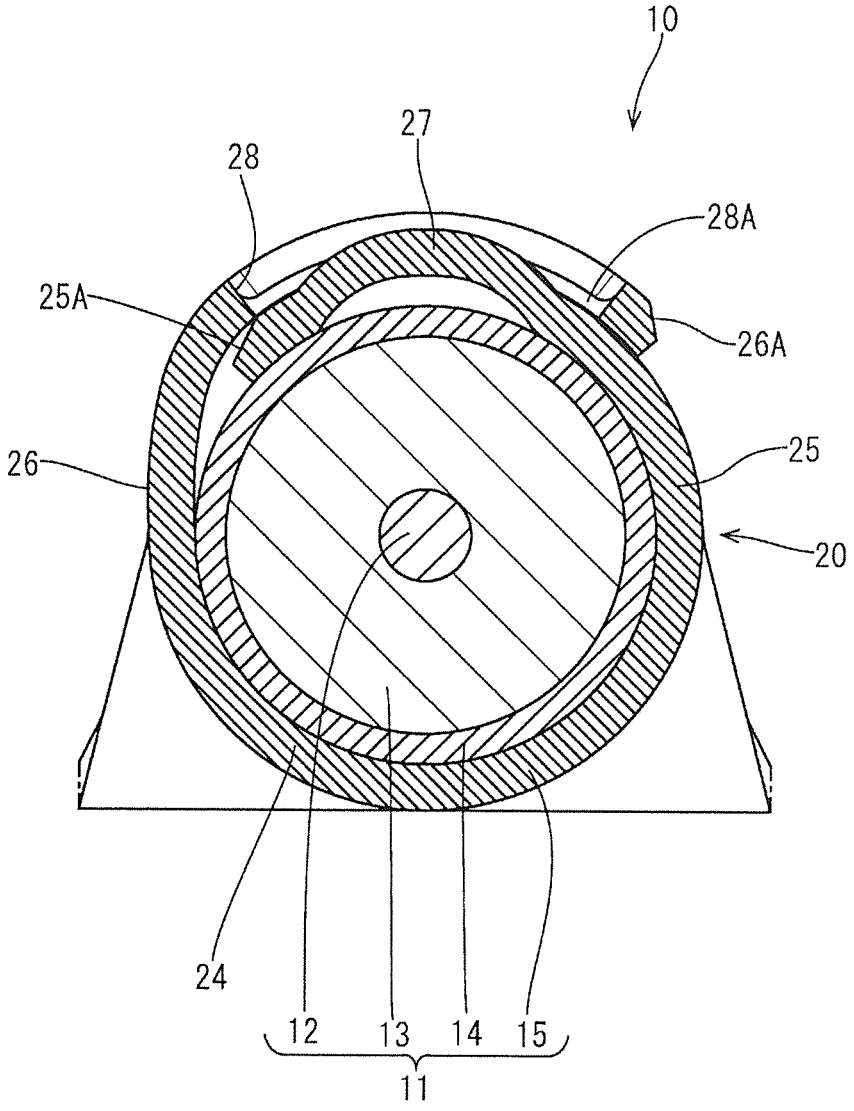
FIG. 6 is a section along B-B of FIG. 5.
Figure 7:
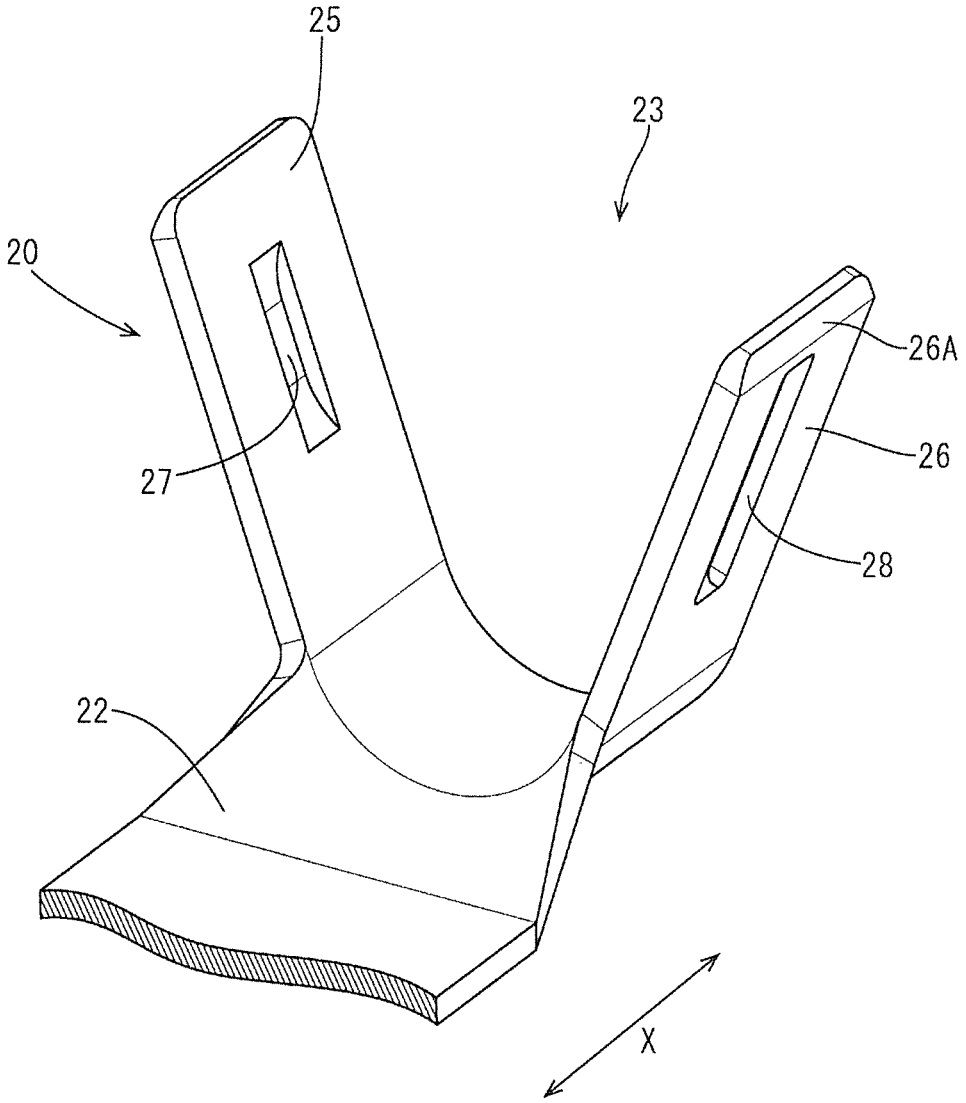
FIG. 7 is a partial enlarged perspective view of a terminal.
Figure 8:
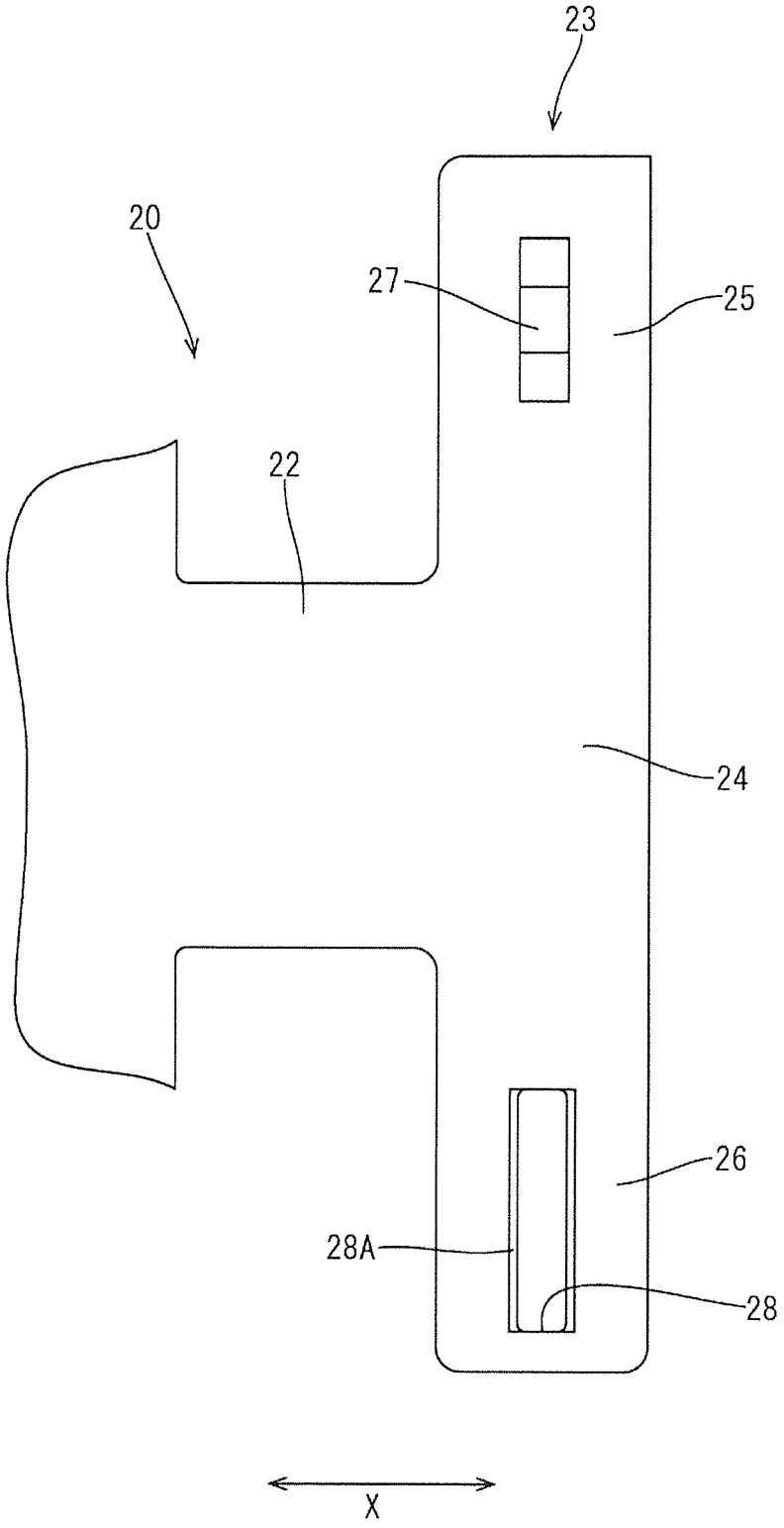
FIG. 8 is a partial enlarged plan view of the terminal.

Out of the pair of barrel pieces 25, 26, the left barrel piece in FIG. 7 is referred to as a first barrel piece 25 and a right barrel piece is referred to as a second barrel piece 26 below. The barrel pieces 25, 26 that are crimped to the shield layer 14 are in an overlapping state in which the first barrel piece 25 is disposed on an inner side and the second barrel piece 26 is overlapped on an outer side of the first barrel piece 25 (see FIGS. 1 and 6).

The first barrel piece 25 is formed with an engaging protrusion 27 projecting radially outward of the cable 11 in the crimped state. The engaging protrusion 27 has a long and narrow shape extending along an extending direction of the first barrel piece 25 (direction substantially perpendicular to an extending direction of the cable 11) and hence extending along a circumferential direction of the cable 11 in the crimped state, and has a substantially flat chevron shape such that a central part is higher in the circumferential direction of the first barrel piece 25 and both end parts are inclined gently. Further, the engaging protrusion 27 rises substantially vertically with respect to a plate surface of the first barrel piece 25 in the extending direction X of the cable 11 (see FIG. 4). This engaging protrusion 27 is formed by press-working, and a back side in a projecting direction is recessed.

An engaging hole 28 is provided in an area of the second barrel piece 26 corresponding to the engaging protrusion 27 of the first barrel piece 25 in the crimped state into which the engaging protrusion 27 is fit to be engaged with an edge of the engaging hole 28, i.e. with the second barrel piece 26 overlapped on the outer side of the first barrel piece 25.

The engaging hole 28 is a long hole extending along an extending direction of the second barrel piece 26 (direction substantially perpendicular to the extending direction X of the cable 11), in other words, along the circumferential direction of the cable 11 in the crimped state and having a length somewhat longer than a length (dimension along the extending direction of the first barrel piece 25) of the engaging protrusion 27. Further, a width (dimension along the extending direction X of the cable 11) of the engaging hole 28 is set such that the engaging protrusion 27 is fit snugly into the engaging hole 28, i.e. slightly larger than a width of the engaging protrusion 27.

Figure 4:
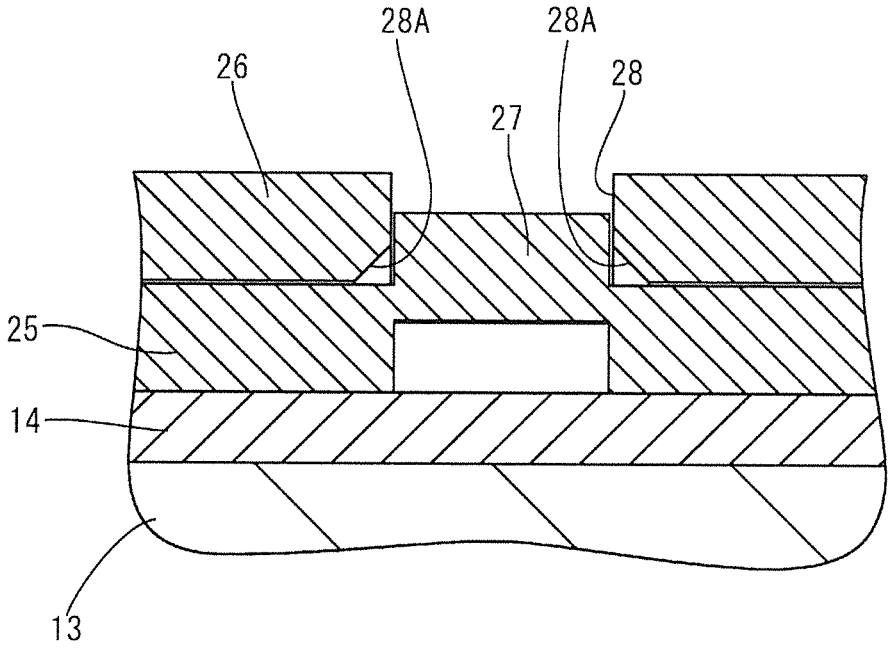
FIG. 4 is a partial enlarged section of FIG. 3.
Figure 5:
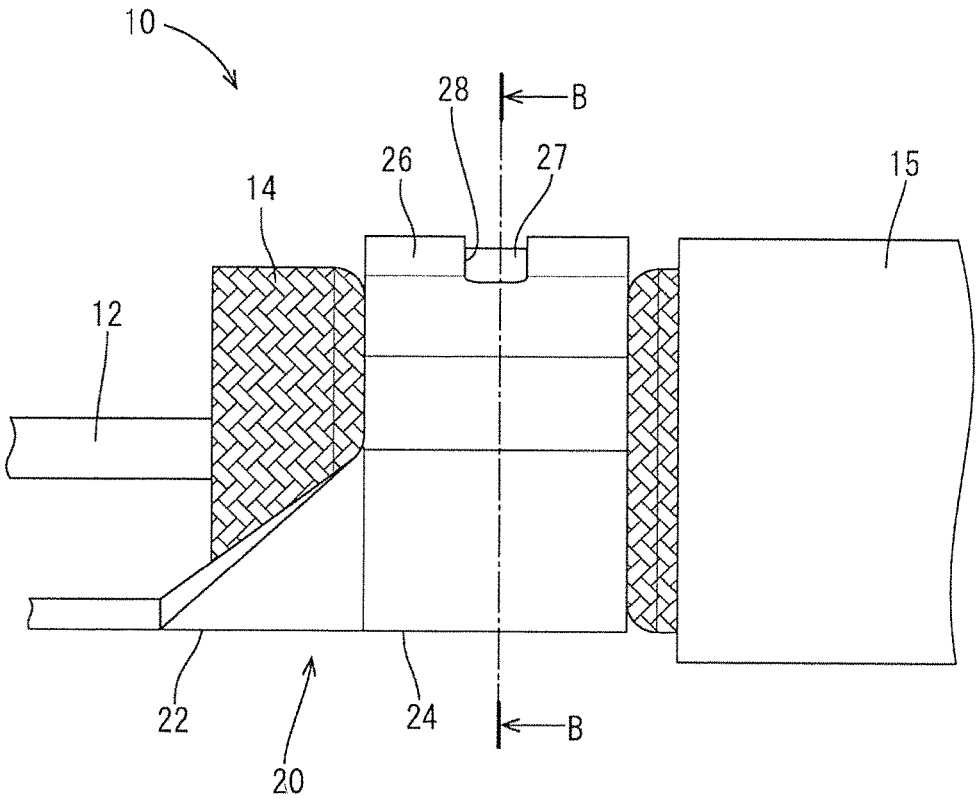
FIG. 5 is a partial enlarged side view of the cable with terminal.
Figure 9:
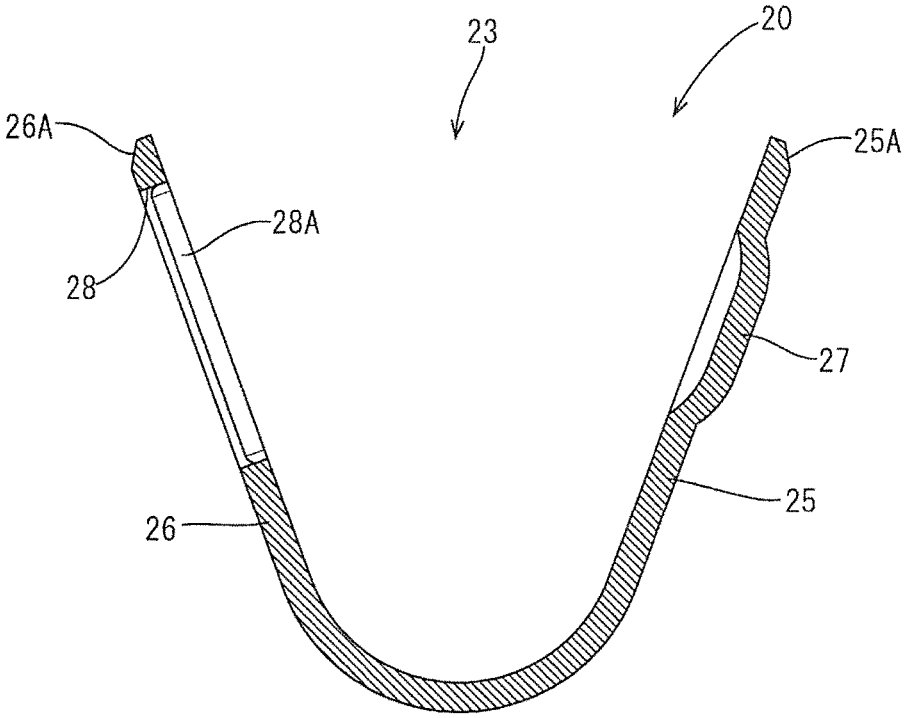
FIG. 9 is a section of the terminal.

Further, corner parts of this engaging hole 28 on the side of the first barrel piece 25 in the crimped state and disposed along the extending direction of the second barrel piece 26 are cut obliquely and serve as guiding portions 28A for guiding the engaging protrusion 27 into the engaging hole 28 (see FIGS. 4 and 9). Note that corner parts other than those provided with the guiding portions 28A are not cut.

A projecting dimension of the engaging protrusion 27 from a surface of the first barrel piece 25 is smaller than a plate thickness of the second barrel piece 25, so that the engaging protrusion 27 does not project from a surface of the second barrel piece 26 in a state engaged with the hole edge part of the engaging hole 28 (see FIG. 4). In this embodiment, a projecting dimension of the engaging protrusion 27 is set to be somewhat larger than half the plate thickness of the second barrel piece 26.

Further, outer sides of leading edges of the first and second barrel pieces 25, 26 are cut obliquely cut (cut parts 25A, 26A) to be tapered (see FIG. 6). In this way, in the crimped state where the barrel pieces 25, 26 are crimped to the shield layer 14, the interference of an outer corner part of the leading edge of the first barrel piece 25 with an inner side of the second barrel piece 26 is avoided and the barrel pieces 25, 26 are overlapped satisfactorily. Further, other components cannot be caught by an outer corner of the leading edge of the second barrel piece 26.

As shown in FIG. 7, the barrel pieces 25, 26 are open up in a single state of the terminal 20 and are crimped to wind around the end of the shield layer 14.

With the barrel pieces 25, 26 crimped to the shield layer 14, the engaging protrusion 27 is engaged with the edge part of the engaging hole 28, as shown in FIG. 4, thereby preventing relative positions of the first and second barrel pieces 25, 26 from being shifted in a front-rear direction. On the other hand, the engaging protrusion 27 is movable to a certain extent in the circumferential direction of the cable 11 in the engaging hole 28 (see FIG. 6).

According to the terminal 20 and the cable 11 of this embodiment, the engaging protrusion 27 and the edge of the engaging hole 28 of the barrel pieces 25, 26 are engaged in the crimped state where the barrel pieces 25, 26 of the terminal 20 (outer terminal) crimped to the shield layer 14 of the cable 11. Thus, even if a tensile force is applied to the cable 11 in an axial direction of the cable 11, the tips of the barrel pieces 25, 26 are not pulled together with the cable 11 (shield layer 14) and shifted from an original crimping position. In other words, even if a tensile force is applied to the cable 11 (shield layer 14) in the axial direction of the cable 11, the barrel pieces 25, 26 can be held in the state crimped to the shield layer 14 with a force substantially uniform in the circumferential direction of the cable 11 and an excellent fixing force.

Thus, a separation distance between the core 12 and the shield layer 14 is kept constant in the circumferential direction. Therefore the cable with terminal 10 can be excellent in high frequency characteristic.

The engaging protrusion 27 and the edge of the engaging hole 28 are long and narrow in the direction substantially perpendicular to the extending direction X of the cable 11 and extend along the circumferential direction of the cable 11 in the crimped state. Thus, if a tensile force is applied to the cable 11 (shield layer 14) in the axial direction of the cable 11, the force can be received by a wide area and the engaged state can be maintained. Thus, the barrel pieces 25, 26 are crimped more stably to the shield layer 14.

The engaging protrusion 27 has the projecting dimension smaller than the plate thickness of the second barrel piece 26 and does not project from the surface of the second barrel piece 26. Thus, the engaging protrusion 27 does not interfere with or catch other components.

The first barrel piece 25 is disposed on the inner side in the crimped state and is provided with the engaging protrusion 27. The second barrel piece 26 is disposed on the outer side and is provided with the engaging hole 28. Thus, a crimping operation can be performed easily while visually confirming the positioning of the engaging protrusion 27 and the engaging hole 28.

The invention is not limited to the above illustrated and described embodiment. For example, the following embodiments also are included in the scope of the invention.

Figure 10:
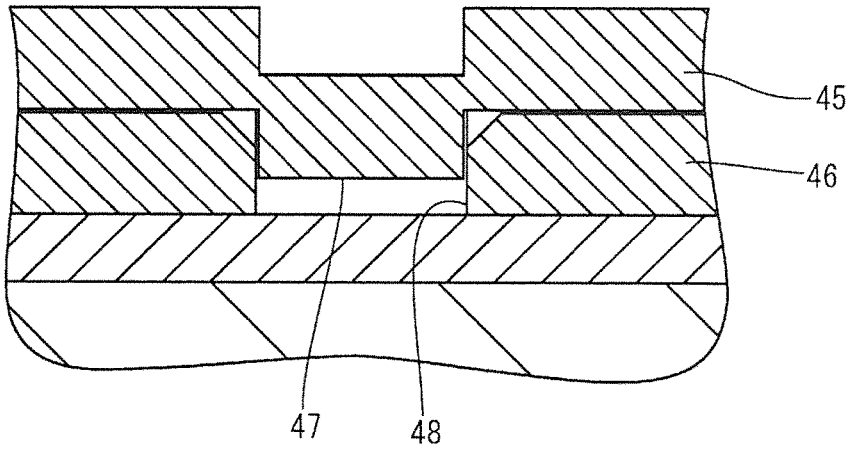
FIG. 10 is a partial enlarged section showing an engaging portion of a cable with terminal of another embodiment.
Figure 11:
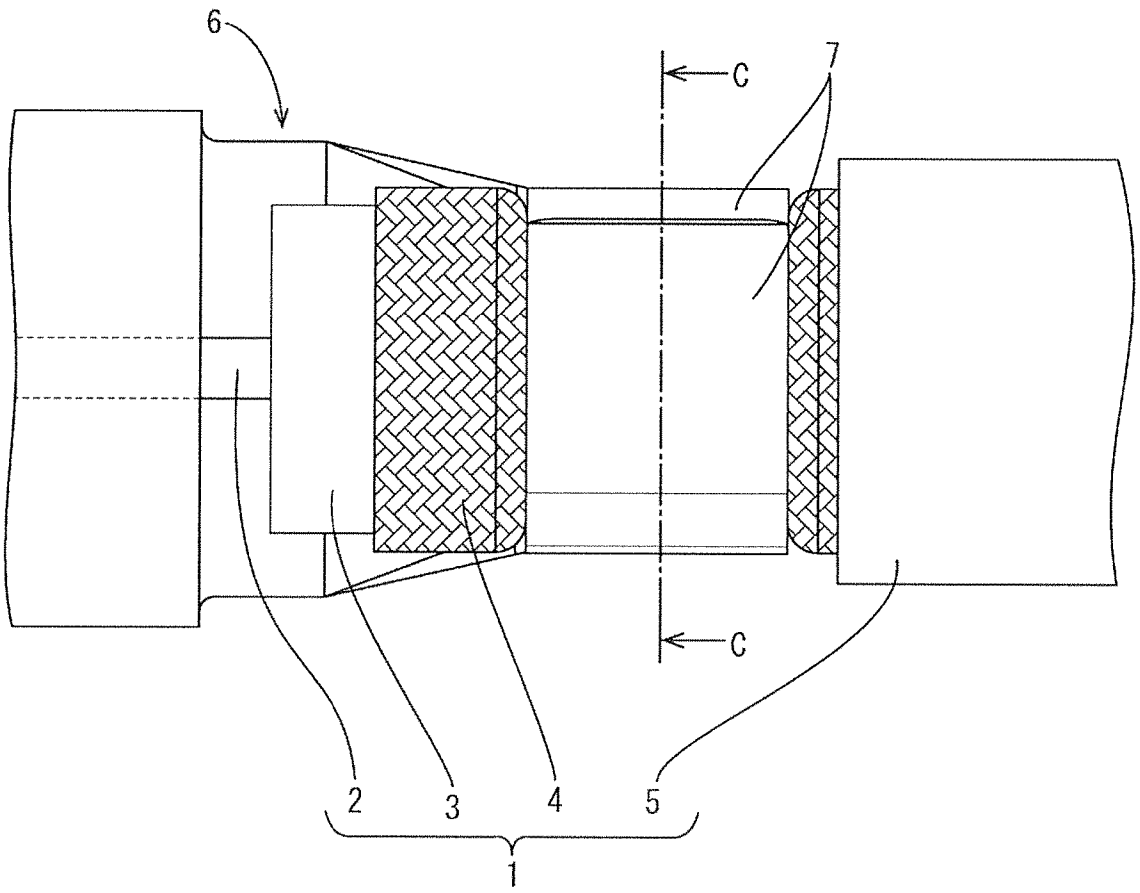
FIG. 11 is a partial enlarged plan view of a conventional cable with terminal.
Figure 12:
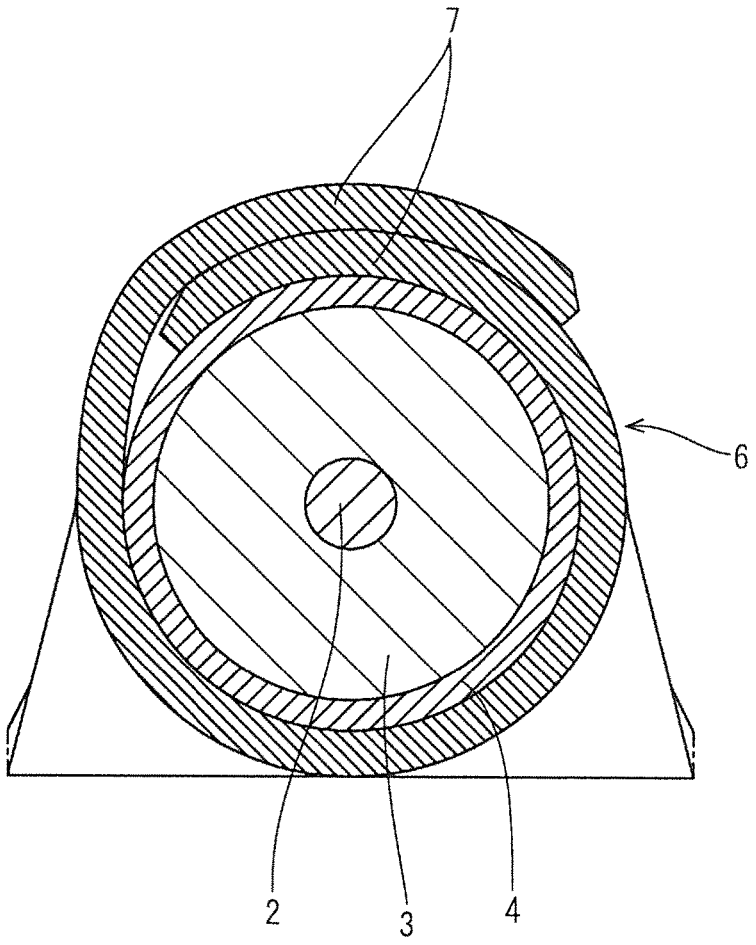
FIG. 12 is a section along C-C of FIG. 11.
Figure 13:
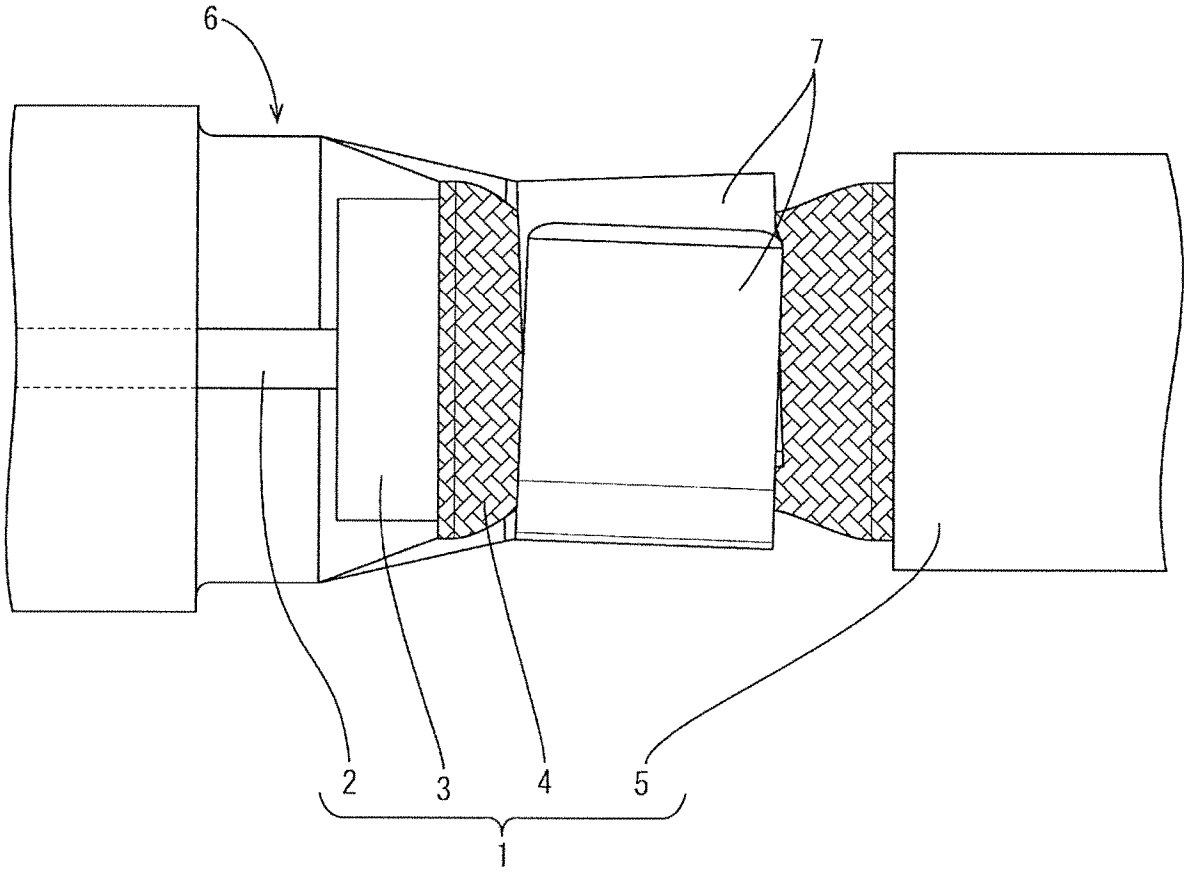
FIG. 13 is a partial enlarged plan view of the conventional cable with terminal when a coaxial cable is pulled in an axial direction.
Figure 14:
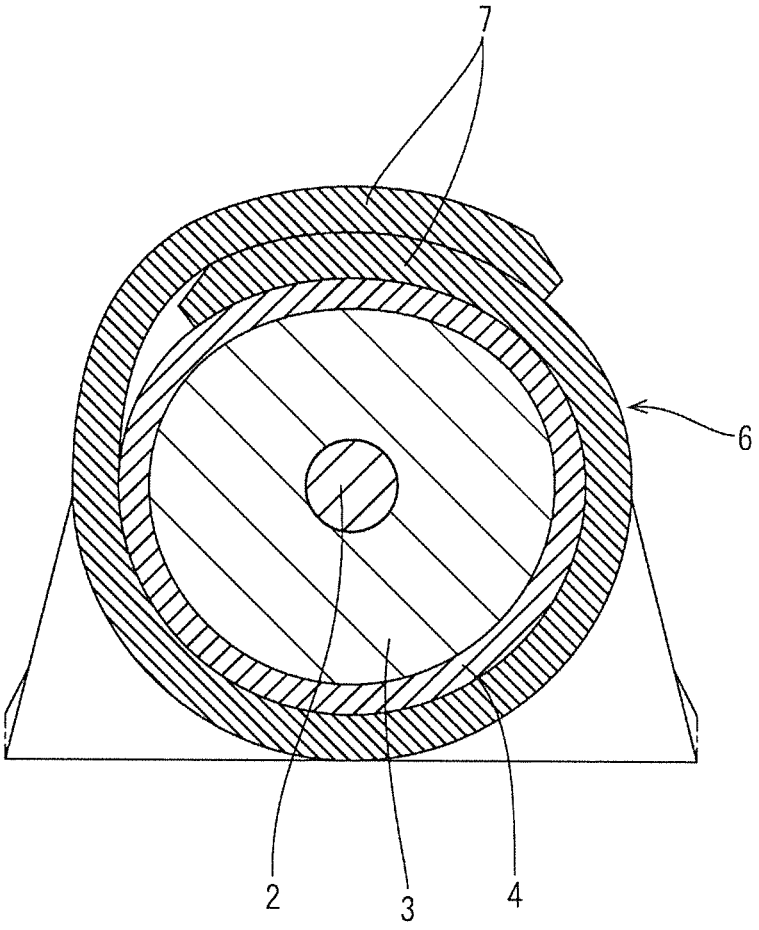
FIG. 14 is a section of the conventional cable with terminal.

The engaging protrusion 27 projects out of the first barrel piece 25 and engages the edge of the engaging hole 28 of the second barrel piece 26 overlapped on the outer side in the above embodiment. However, an engaging protrusion 47 may project in and engage with an edge of an engaging hole 48 of a second barrel piece 46 overlapped on an inner side, as shown in FIG. 10.

The engaging protrusion 27 and the edge of the engaging hole 28 are long and narrow in the direction substantially perpendicular to the extending direction X of the cable 11 in the above embodiment, but these may extend obliquely to the extending direction X of the cable 11. Further, these may have a circular shape (cylindrical shape) or a rectangular shape (rectangular tube shape) that is not long and narrow without being limited to the long and narrow shape.

The projecting dimension of the engaging protrusion 27 is smaller than the plate thickness of the second barrel piece 26 in the above embodiment. However, this projecting dimension may be equal to the plate thickness of the second barrel piece 26 or may be so set that the engaging protrusion 27 projects from the surface of the second barrel piece 26.

Although the engaging hole 28 is a through hole penetrating through the second barrel piece 26 in the above embodiment, a bottomed engaging hole in the form of a recess is also included in the invention.

Although the terminal 20 of the above embodiment includes no barrel piece to be crimped to the outer insulating layer 15, a configuration including barrel pieces to be crimped to the outer insulating layer 15 is included in the invention.

Although the shield layer 14 is formed of the braided wire in the above embodiment, there is no limitation to the braided wire. For example, a shield layer may be formed of a metal thin film or the like.

Although the engaging protrusion 27 is movable in the circumferential direction of the cable 11 in the engaging hole 28 in the above embodiment, the lengths of the engaging protrusion 27 and the engaging hole 28 may be set substantially equal so that the engaging protrusion 27 is not movable also in the circumferential direction of the cable 11.

LIST OF REFERENCE SIGNS

10: cable with terminal
11: cable (coaxial cable)
12: core
13: inner insulating layer
14: shield layer
15: outer insulating layer
20: terminal
23: crimping portion
25: first barrel piece (barrel piece on one side)
26: second barrel piece (barrel piece on other side)
27: engaging protrusion
28: engaging hole
X: extending direction of cable

The invention claimed is:

1. A terminal to be connected to a coaxial cable in which a core, an inner insulating layer, a shield layer and an outer insulating layer are concentrically arranged from an inner side to an outer side, comprising:

first and second barrel pieces to be crimped in an overlapping state to an exposed part of the shield layer;

an engaging protrusion provided on the first barrel piece, the engaging protrusion projecting toward the first barrel piece on the other side out of the pair of barrel pieces in a crimped state where the barrel pieces are crimped to the shield layer; and an engaging hole provided in the second barrel piece on the other side, the engaging protrusion being engaged with an edge of the engaging hole in the crimped state;

the engaging protrusion rising vertically with respect to a plate surface of the barrel piece in an extending direction of the coaxial cable;

the engaging hole having the hole edge extending in a direction perpendicular to the extending direction of the coaxial cable; and a dimension of the engaging hole along the extending direction of the coaxial cable being set such that the engaging protrusion is fit snugly into the engaging hole while a dimension along the direction perpendicular to the extending direction of the coaxial cable is set such that the engaging protrusion is movable in the engaging hole.

2. The terminal of claim 1, wherein the engaging protrusion and the edge of the engaging hole extend to be long and narrow in the direction perpendicular to the extending direction of the coaxial cable.

3. The terminal of claim 1, wherein a projecting dimension of the engaging protrusion from a surface of the barrel piece on the one side is so set that the engaging protrusion does not project from a surface of the barrel piece on the other side with the engaging protrusion engaged with the edge part of the engaging hole.

4. The terminal of claim 1 is provided to project radially outwardly of the coaxial cable in the crimped state.

5. A cable with terminal, comprising:

a coaxial cable in which a core, an inner insulating layer, a shield layer and an outer insulating layer are concentrically arranged from an inner side to an outer side; and a terminal connected to the coaxial cable, the terminal including first and second barrel pieces crimped in an overlapping state to an exposed part of the shield layer;

an engaging protrusion being provided on the first barrel piece, the engaging protrusion projecting toward the second barrel piece to be engaged an edge part of an engaging hole provided in the second barrel piece; and the engaging protrusion rising vertically with respect to a plate surface of the barrel piece in an extending direction of the coaxial cable and being fit snugly between the hole edge of the engaging hole extending in a direction perpendicular to the extending direction of the coaxial cable while being movable in the engaging hole in a circumferential direction of the coaxial cable.

6. The cable with terminal of claim 5, wherein the engaging protrusion and the edge of the engaging hole extend to be long and narrow in the direction perpendicular to the extending direction of the coaxial cable.

7. The cable with terminal of claim 5, wherein a projecting dimension of the engaging protrusion from a surface of the barrel piece on the one side is so set that the engaging protrusion does not project from a surface of the barrel piece on the other side.

8. The cable with terminal of claim 5, wherein the second barrel piece is crimped while being overlapped on an outer side of the first barrel piece.

* * * * *